United States Patent [19]

Jasinski

[11] Patent Number: 4,793,421

[45] Date of Patent: Dec. 27, 1988

[54] PROGRAMMED AUTOMATIC DRILL CONTROL

[75] Inventor: Richard A. Jasinski, Oak Creek, Wis.

[73] Assignee: Becor Western Inc., South Milwaukee, Wis.

[21] Appl. No.: 73,910

[22] Filed: Jul. 13, 1987

Related U.S. Application Data

[63] Continuation of Ser. No. 849,538, Apr. 8, 1986, abandoned.

[51] Int. Cl.[4] ..... E21B 44/00

[52] U.S. Cl. ..... 175/27; 173/6; 173/11; 175/38; 364/420

[58] Field of Search ..... 175/27, 38, 24; 173/6, 173/11, 12; 364/420, 149, 511

[56] References Cited

U.S. PATENT DOCUMENTS

| | | | |
|---|---|---|---|
| 3,058,532 | 10/1962 | Alder | 175/39 |
| 3,517,553 | 6/1970 | Williams et al. | 73/152 |
| 3,520,375 | 7/1970 | Raynal et al. | 175/24 |
| 3,581,830 | 6/1971 | Stoner | 173/6 |
| 3,593,807 | 7/1971 | Klima | 173/6 |
| 3,605,919 | 9/1971 | Bromell et al. | 175/38 |
| 3,613,805 | 10/1971 | Lindstad | 175/27 |
| 3,971,449 | 7/1977 | Nylund et al. | 175/27 |
| 4,030,558 | 6/1977 | Morris | 175/39 |
| 4,165,789 | 8/1979 | Rogers | 175/27 |
| 4,354,233 | 10/1982 | Zhukovsky et al. | 364/420 |

*Primary Examiner*—Hoang C. Dang

*Attorney, Agent, or Firm*—Quarles & Brady

[57] ABSTRACT

A programmed automatic drill control for optimizing the drilling of subterranean holes by large drilling machinery such as blast hole drills. Sensing means are provided to sense a first set of drilling parameter limits to effect maximum r.p.m. of the motor to rotate the pipe drilling bit and to sense a second set of drilling parameter limits to effect a maximum rate for the motor to drive the hoist pull-down mechanism. These conditions will prevail until a sensed limit is reached or the drilling conditions require operation along a torque or force limit set value. When a limit is reached, the control will regulate at a value of r.p.m. or rate which is consistent with maintaining operation at the limit value. In a preferred embodiment, the sensing of a first set of drilling parameters include a sensing of head position of the pipe drilling bit, the force on the drilling bit as well as vertical and horizontal vibration of a drilling pipe and the sensing of a second set of drilling parameters include sensing head position of the pipe drilling bit, the horizontal and vertical vibration of the drilling pipe, the rotary amps and speed of the motor to drive the drill pipe and the air pressure in the drill pipe.

10 Claims, 7 Drawing Sheets

PROGRAMMED AUTOMATIC DRILL CONTROL

This application is a continuation of application Ser. No. 849,538, filed Apr. 8, 1986, now abandoned.

BACKGROUND OF THE INVENTION

The field of the invention is automatic drill control for earth drilling machines, and more particularly to computer controlled drilling in a blast hole drill wherein drilling conditions of the blast hole drill are continuously sensed and the penetration rate and drilling rotational speed are optimized independently.

Various prior art systems have been developed utilizing computers to automatically control large drilling apparatus. For example, in the Zhukovsky, et al. U.S. Pat. No. 4,354,233 a computer is utilized in conjunction with a blast hole drill for computing the value of drilling hole penetration for a single revolution. The computer is connected to means for comparing the current value of a drilling tool penetration per single revolution with preset values. The computer is connected with its inputs to transducers and setters of input parameters, such as rotation frequency, axial load, torque, and the vibration speed of a rotary drill. In the Rogers U.S. Pat. No. 4,165,789 a control algorithm and a microcomputer is employed with a memory to maintain a maximum rate of penetration for drilling roof bolt holes. Optimization is based on regulating drill revolutions per minute and thrust while holding one of those parameters constant and varying the other. Control systems for blast hole drills are also described in U.S. Pat. Nos. 3,581,830; 3,593,807 and 3,613,805 with the Nos. '830 and '805 patents being commonly assigned. In the No. '830 patent the control system balances rotary torque and downfeed force to reduce downfeed speed when torque feedback exceeds a predetermined value. Signals derived from both torque and drilling rate are utilized in the No. '807 patent to provide optimum efficiency of operation. Automatic depth control is provided in the control system described in the No. '805 patent as well as automatic shut down.

Although automatic drill control systems have been constructed and used, they have not been employed to optimize the automatic drilling of a blast hole in the most efficient manner. One of the prior art systems is directed toward optimizing drilling rates by holding certain drilling parameters constant while varying others in search of optimization. Another compares torque with a signal which may in part be based on human experience and effects a further signal to control through the motor drive a downward pressure on the drill so that a maximum drilling rate can be obtained through strata of various and different composition.

It is an advantage of the present invention to provide an improved control system for drilling subterranean holes.

It is another advantage of this invention to provide a drill control system of the foregoing type which effects optimization in an automatic manner.

It is still another advantage of this invention to provide a control system of the foregoing type which can provide a maximum penetration rate within restraints of the blast hole drill (BHD).

It is yet another advantage of the present invention to provide a control system of the foregoing type which results in reduced maintenance and down time through efficient and proper operation of the BHD.

It is still another advantage of this invention to provide a control system of the foregoing type which can be readily adapted to currently used BHDs.

SUMMARY OF THE INVENTION

The foregoing advantages are accomplished and the shortcomings of the prior art overcome by the programmed automatic drill control (PADC) system of this invention which is capable of optimizing drilling of subterranean holes by large drilling machinery such as BHDs. This type of machinery will have the usual electric rotary drilling motor and hoist pulldown mechanism with motors mounted in a mast. The rotary motor will effect a rotary movement of that drill pipe and the hoist pulldown motor will cause a pulldown mechanism to exert a downward force on the drill pipe as it is being rotated. The drill control system includes means to sense a first set of drilling parameter limits and to effect maximum revolutions per minute (r.p.m.) for the electric motor to rotate the pipe drilling bit. Means are also employed to sense a second set of drilling parameter limits and to effect a maximum rate for the electric motor to drive the hoist pulldown mechanism. The maximum r.p.m. and the maximum rate are effected to operate the electric motors at maximum capacity while encountering various types of earth formations.

In one preferred embodiment, the means to sense the first set of drilling parameter limits includes means to sense head position of the pipe drilling bit, the force on the drilling bit, as well as vertical and horizontal vibration of a drilling pipe.

In yet another embodiment, the means to sense the second set of drilling parameter limits includes means to sense head position of the pipe drilling bit, the horizontal and vertical vibration of the drilling pipe, the force on the drill pipe and the rotary amps and speed of the motor to rotate the drill pipe and the air pressure in the drill pipe.

In another embodiment, means are operatively connected to said sensing means for the rotary amps and speed of the drill pipe motor to sense stalling o the bit and to effect a hoist control operation.

In still another embodiment, means are afforded in conjunction with the means to sense the air pressure to sense a clogged drilling hole and to effect a hoist control operation.

The drill control system of this invention differs from the prior drill control systems in commanding the maximum desired r.p.m for the electric drilling motor and the rate for the hoist pulldown mechanism. These values are maintained until sensed limits are reached or the drilling conditions require operation along the force and torque limit set values. When the limits are reached, the control system will regulate at a value of r.p.m. or rate which is consistent with maintaining operation at the limit values. Unlike the prior art systems, the parameters monitored for the limits are rotary current overload, excessive vertical and/or horizontal vibration and excessive main air pressure. During operation in the force or torque limit region, the actual r.p.m. or rate of penetration will b dictated by the material being drilled. In the instance of commanding the maximum drilling r.p.m., if the drill bit operational specifications or a horizontal or vertical vibrations limit is reached during operation in the torque limit region and in the instance of commanding the maximum drilling rate, if a rotary current, horizontal or vertical vibration or air pressure limit is reached during operation in the force limit region, the control system will regulate based on the actual value of developed r.p.m. or rate not the desired maximum r.p.m. or rate.

DESCRIPTION OF THE PREFERRED EMBODIMENT

Figure 1:
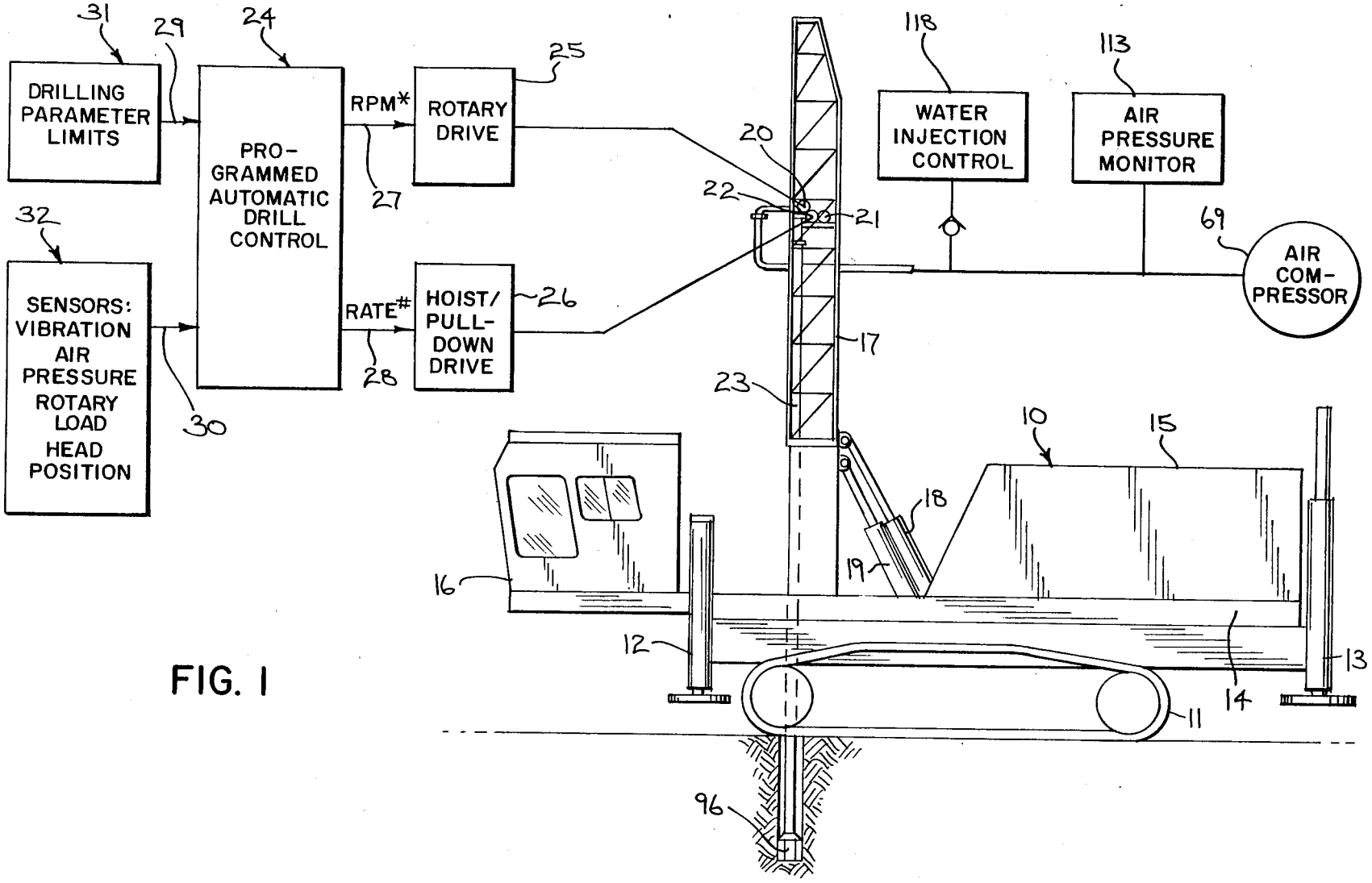
FIG. 1 is a plan view of a blast hole drill shown in conjunction with the control system of the present invention, which is illustrated in a diagrammatic block representation.

Referring to FIG. 1, a blast hole drill generally 10 includes the usual crawler vehicle 11 by which it can be moved from location to location. It is supported in a working position and raised and lowered to this position by four double acting hydraulic jacks with one of the rear jacks shown at 12 and one of the front jacks shown at 13. The jacks are mounted on a main frame 14 which is supported on the crawler and serves as a platform for the drill mast 17. The drill mast is raised and lowered by the hydraulic cylinder 18 and the telescoping strut 19 as well as suitably positioned for angle drilling. Also supported on the main frame 14 is the operations cab 16 and the housing 15 for operating machinery. Positioned in the mast 17 are the usual rotary motor 20 for rotating the drill pipe 23 and the bit 96. Also positioned in the mast 17 is a hoist pulldown mechanism 21 including a hoist pulldown motor 22. The PADC generally 24 is shown operatively connected to a rotary drive 25 for the rotary motor 20 as well as a hoist pulldown drive 26 for the hoist pulldown motor 22. The PADC 24 at its output side controls the r.p.m. command 27 for the rotary drive 25 and the rate command 28 for the hoist pulldown drive 26. As indicated, the PADC is connected at its input side 29 and 30 to certain drilling parameter limits generally 31 and certain sensors generally 32 for controlling rotary drive r.p.m. command 27 and for controlling the rate command 28 of the hoist pulldown drive 26.

In the drawing an * designation is indicated in conjunction with certain descriptions. These are commonly used in the industry to indicate a command signal.

Figure 2:
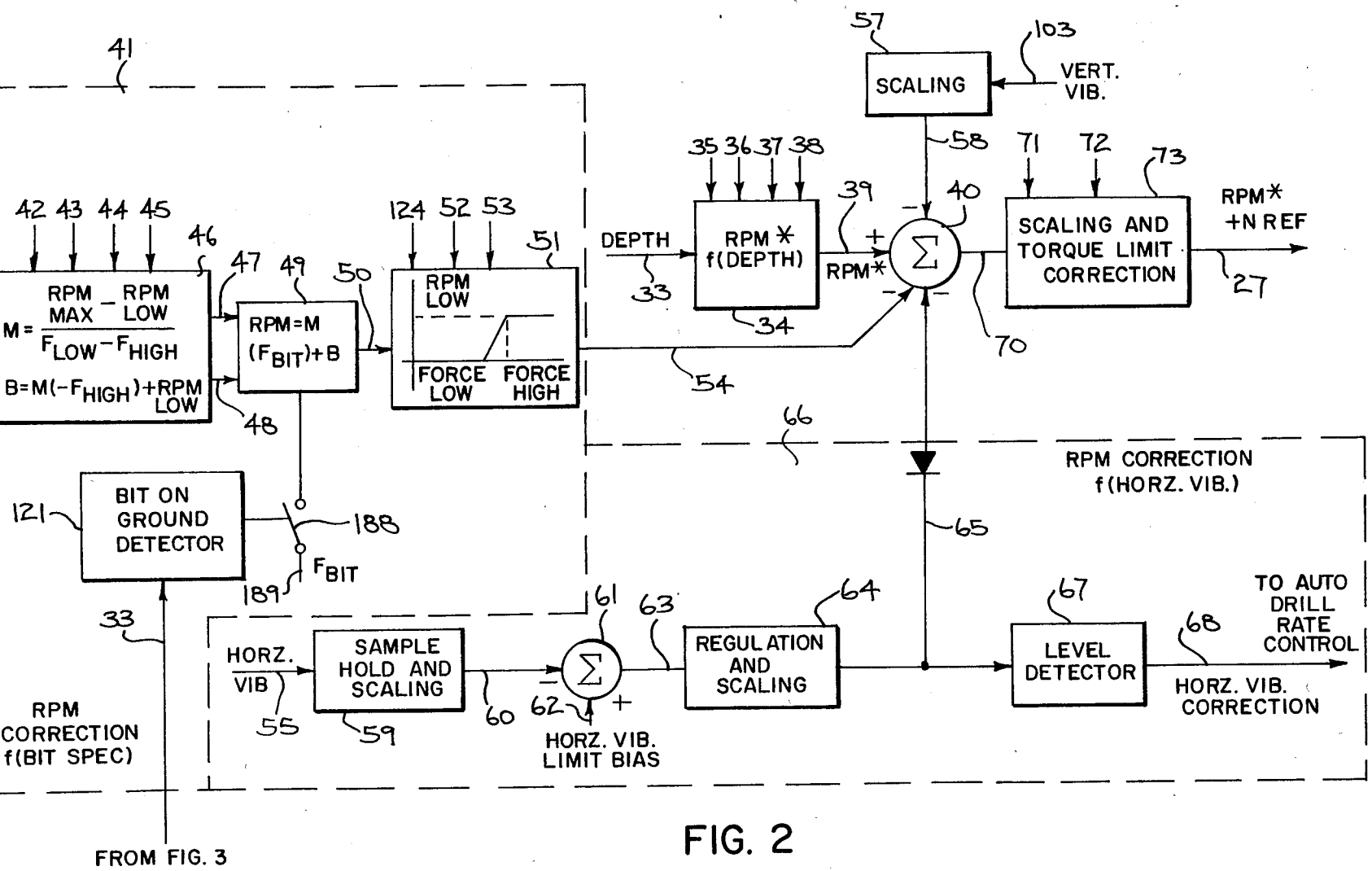
FIG. 2 is a function block diagram of the control portion for the rotary drive of the system of FIG. 1.

Referring now to FIG. 2, the means to sense the first set of sensed drilling parameter limits and the sensors for controlling the rotary drive r.p.m. command 27 is described in detail. It will include a head depth determination 33 determined in the algorithm function box 34 into which is placed the inputs of hole depth 35, maximum desired r.p.m. 36, collar depth 37 and minimum desired r.p.m. 38. With the r.p.m. command 39 set as a function of depth, the remaining algorithm in the generation of the final reference command 70 will act to reduce the r.p.m. if a monitored parameter limit is exceeded. These r.p.m. correction routines, once active, will correct the r.p.m. to a level which will maintain the monitored parameter at its limit. This will be effected basically through the summer 40 as will another limit determination which is an r.p.m. correction 41 for the drilling bit operational specifications. It is based on maintaining a specified relationship between the speed (r.p.m.) of the bit and the force applied to the bit. This is effected by inputting the maximum r.p.m. 42, the low r.p.m. 43, a high force 44 and a low force limits 45 into algorithm function box 46 which applies the indicated formula wherein M represents the slope of the r.p.m. force function and B represents a r.p.m. X-Y graph intercept with a force equal to zero as represented by the equation $Y=B+Mx$ with M indicating the slope. The M results 47 and the B results 48 of these formulae are further applied in algorithm function box 49 where the indicated formula is applied in conjunction with the actual force 189 on the bit 96 when switch 188 is closed by the bit on ground detector 121. This results in a calculated r.p.m. 50 which represents the maximum r.p.m. allowable at the present magnitude of force. This calculated r.p.m. 50 is fed into function box 51 which has an r.p.m. low input 124, a low force input 52 and a high force input 53. This information will be factored according to the indicated parameter graph to result in an r.p.m. correction factor as a function of force for bit specifications 54 which is also added to the summer 40.

The means to sense the first set of sensed drilling parameter limits and the sensors also include a horizontal vibration input 55 indicated as a r.p.m. correction as a function of horizontal vibration 66 and a vertical vibration input 1O3. Vibration input signal 1O3 is subjected to a scaling function in the scalar box 57, the resulting r.p.m. correction as a function of vertical vibration 58 being fed to the summer 40. The horizontal vibration input 55, as is the vertical vibration input 56, is first effected by detection means composed of an accelerometer (not shown) and a transducer (not shown). In this instance the vertical vibration sensing means is placed on the base of the mast 17 and the horizontal vibration sensing means is positioned on the drilling main frame 14 next to the mast 17. The horizontal input 55 is directed into a function box 59 where a sample hold and scaling function will take place. The resultant signal 60 representing a magnitude of horizontal vibration is fed to a summer 61 and compared to a horizontal vibration limit bias 62, the output 63 of which is directed into a regulator and scaling function 64. The resulting r.p.m. correction factor for horizontal vibration 65 is fed to the summer 40. This horizontal vibration correction factor 65 is also subjected to a minimum level detector function in function box 67 resulting in a horizontal vibration correction 68. This vibration correction is used to reduce the drilling rate by means of an automatic drill rate control as represented at 68 in FIG. 3 as will be later explained. Referring again to the summer 40, the r.p.m. correction factor as a function of the bit specification 54 and as a function of the r.p.m. 58 and 65 of the vertical and horizontal vibration r.p.m. correction factor reduce the r.p.m. command 39 in the summer 40 to a resultant r.p.m. command 70 to a value which will hold these factors at a set limit. The resultant r.p.m. command 70 can be further corrected for torque rotation 71 and the speed of rotation 72 in a scaling and torque limit correction box 73. It should be pointed out that in this instance the torque limit correction will take into account what conditions are taking place in terms of what the BHD 10 is experiencing with respect to torque, speed and conditions encountered. These correction factors will reduce the resulting value of r.p.m. command 27 to effect operation of the BHD 10 along a torque limit set value by governing the rotary drive 25 of the rotary motor 20.

Figure 3:
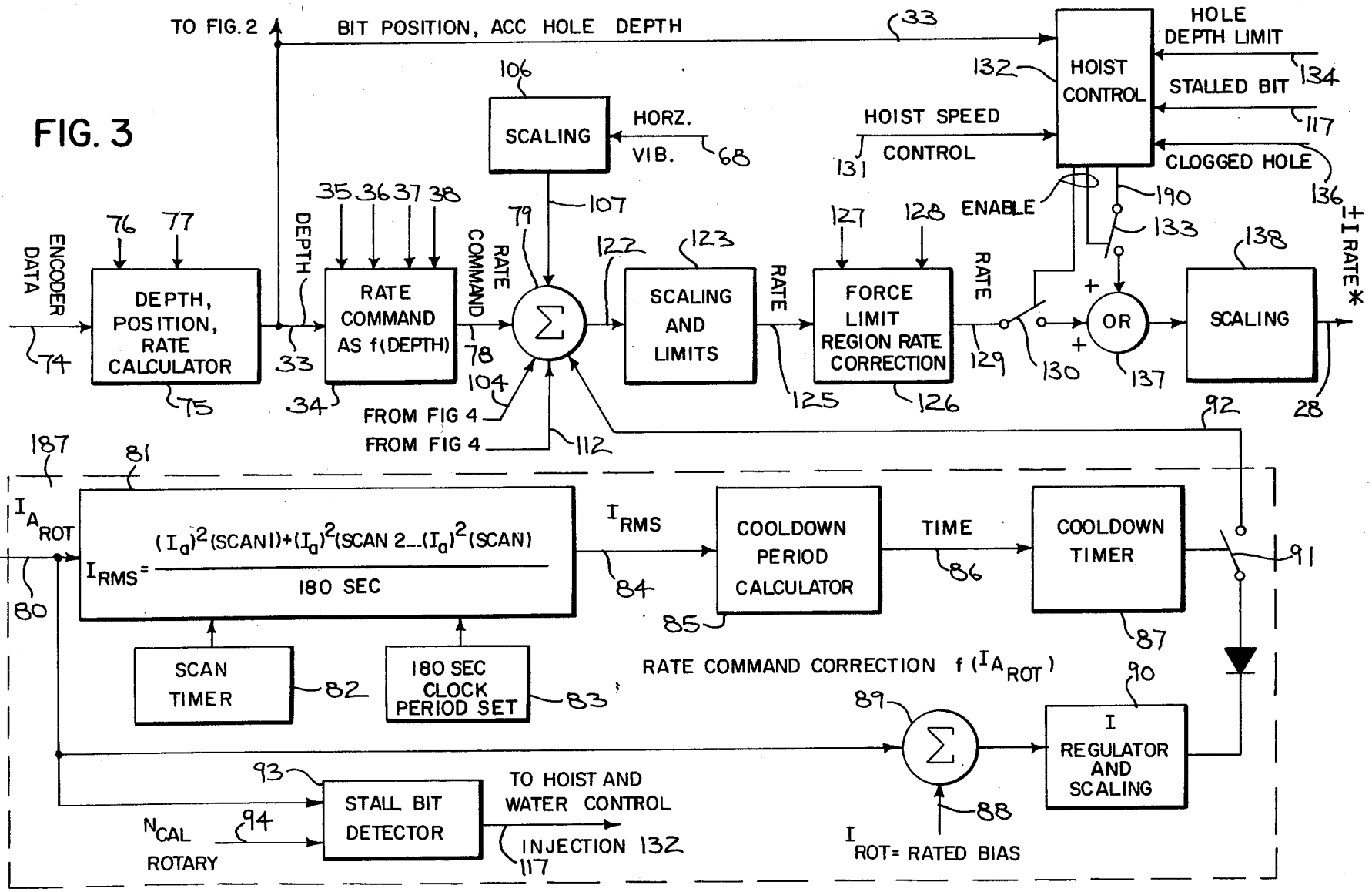
FIG. 3 is a functional block diagram of part of the control portion for the hoist pulldown drive of the system of FIG. 1.

The means to sense the second set of sensed drilling parameter limits and the sensors which determine the rate 28 of drilling are now described, first with reference to FIG. 3. The first involves the setting of the rate command 28 as a function of depth. This is accomplished by entering encoder data 74 indicating the depth of the drill bit 96 in a depth position calculation box 75 which will contain the zero reset 76 and a tool wrench 77 input. The zero reset 76 is used to define a zero point or start of the hole. The tool wrench input 77 is employed to detect when the drill bit 96 is not moving because the drill pipe 23 is clamped. In this instance the encoder will be of the usual type and located in the hoist machinery drill box such as indicated at 21. As stated previously in conjunction with FIG. 2 and the function box 34, the head depth 33 will be calculated in conjunction with calculations for a hole depth 35, a maximum rate 36, a collar depth 37 and a collar rate 38 in the function box 34 to result in a desired rate command 78 as a function of depth for input into the summer 79. With the rate command set as a function of depth, the remaining algorithms in the generation of the final reference command 122 will act to reduce the rate if a monitored parameter limit is exceeded. These rate correction routines, once active, will correct the rate to a level which will maintain the monitored parameter at its limit. This will be effected basically through the summer 79 as will be further explained. Another determination which composes one of the sensors 32 is a determination of the rate command 28 as a function of the rotary load 80 of the motor 20 to rotate the drill pipe 23. This is based on calculating the root-mean-square (RMS) armature current in the function box 81 by the indicated formula wherein $Ia^2$32 the square of the armature current and SCAN means the time required for the computer 140 to go through the program one time. The RMS current is calculated over a fixed time period as indicated by a scan timer 82 and a 100 second clock 83.

In this function box 81 the RMS current is compared to the rated motor current of the rotary drill motor 20. If the RMS current 84 is greater than the rated motor current, a cooldown period of time is calculated such as in the cooldown calculator 85. The cooldown period is the time in which the rotary motor must operate at a reduced load such that the RMS current for the combined fixed and cooldown period is equal to the rated motor current. This is accomplished through the time signal 86 in conjuction with the cooldown timer 87 to operate the switch 91. The rotary load 80 is also added to the summer 89 with the current at a rated bias 88, the result of which is added and further regulated by the amp regulator and scaling function 90. When the switch 91 is closed through the influence of the cooldown timer 87, the resulting rate correction as a function of Rotary Load (RC*RL) 92 will be added to the summer 79. The RC*RL is thereby active during the cooldown period. It reduces the rate command 122 to a value which causes rotary load to be at its reduced cooldown period load.

If at any time during the run-pulldown mode, a condition of excessive rotary loading of motor 20 at near zero rotary speed is present, a stalled bit routine is activated. This is effected through the function box 93 which will contain a calculated rotary speed (Ncal) input 94. A command signal 117 can be given to a hoist control 132 and change the mode state to a run hoist if a stalled bit routine is detected as well as to terminate the injection of water for dust control. In the run-hoist mode, the PADC will by means of the hoist control 132 and locating knowledge of the bit location 33 off the bottom of the hole attempt to correct the stalled bit condition. If the condition is cleared, the mode is returned to a run-pulldown and the drilling process will continue. If the condition is not cleared the mode is changed to idle and appropriate fault indicating lamps are set as will be discussed later in conjunction with the computer 140 shown in FIG. 5.

Figure 4:
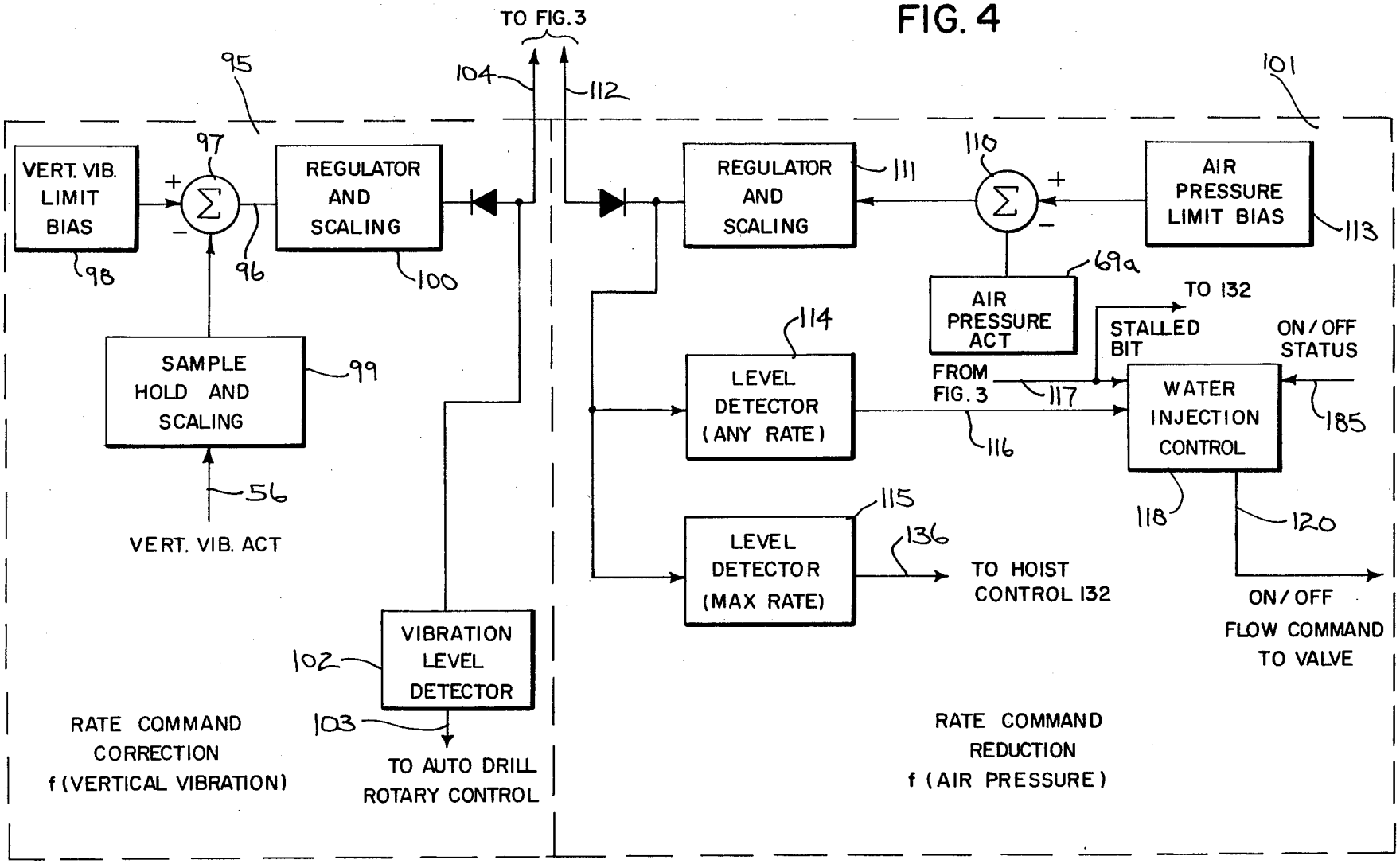
FIG. 4 is a functional block diagram similar to FIG. 3 showing the remaining part of the control for the hoist pulldown drive of the system.

A determination of the rate command 28 correction is also a function of the vertical and horizontal vibration and is based on monitoring the root-mean-square values of the vertical and horizontal acceleration rates of the drill mast 17 and deck 14. This is accomplished by the additional rate command correction based on force of vertical vibration 95 having the vertical vibration sensor input 56 (see FIG. 4). Input 56 is subjected to a sample hold and scaling function 99 before being fed to the summer 97 which also receives signals from a vertical vibration limit bias 98. The signal results 96 of the summer 97 are regulated and scaled such as at the function box 100. The resulting rate correction factor as a function of vertical vibration 104 is added to the summer 79. In addition, the rate correction by horizontal vibration value 1O7 for the previously described horizontal vibration input 68 is introduced to the summer 79 after a scaling function 106 (See FIG. 3). The rate correction factor as a function of vertical vibration 104 and the rate and/or horizontal vibration inputs correction factor as a function of horizontal vibration 107 reduce the rate command 78 in the summer 79 to a resultant rate command 122 to a value which will hold vibration at a set limit. It should be pointed out that the correction rate for vertical vibration has a greater effect at reducing vibration than correction of the rate for horizontal vibration. It should also be noted that there is a vibration level detector 102 utilized in conjunction with the rate correction by vertical vibration value 1O4 for the purpose of detecting a level rate reduction command so as to reduce the r.p.m. in an automatic drill rotary control. This is shown at 103 as a vertical vibration correction signal and is introduced into the summer 40 as previously described in FIG. 2.

The rate command 28 also includes an air pressure detection function 101 for sensing the pressure **69*a* from air compressor pressure 69 which is monitored at 113 and added in the summer 110. If the pressure exceeds a limit as set in regulator and scaling box 111, the rate correction by air pressure 112 reduces the rate command 78 at the summer 79 and output 122 to a value which will hold the main air pressure at its set limit. If the magnitude of the rate correction 112 reaches a level of correction which will cause the rate to equal zero, a clogged bit condition is activated. The water injection control 118 is effected through the rate level detector 114 to issue the clogged bit command 116 to the water injection control 118 which activates an on/off status 120 to command suitable valving to stop water flow. The stalled bit signal 117 from stall bit detector 93 can also cause water injection control 118 to turn off. The level detector 114 in this instance detects any rate reduction command. An on/off status 185 governs the water injection control 118. In a run-hoist operation the PADC will attempt to correct the clogged bit condition. If the condition is cleared, the mode state is returned to a run-pulldown and the drilling process will continue. If the condition is not cleared, the mode is changed to idle and appropriate fault indicating lamps are set as will be explained later in conjunction with FIG. 5. An additional level detector 115 detects a maximum rate correction command and is also connected to the air pressure rate signal 112. It is utilized in conjunction with hoist control 132 for the purpose of activating the hoist control and hoisting the bit 96** off the bottom when a clogged hole is detected. (See FIG. 3).

It will be seen that the summer 79 in conjunction with rate command 78, the vibration factors 107 and 104, the air pressure rate 112 and the rotary load factor 92 effect a rate 28 of pulldown along a drilling parameter limit set value 31 which is consistent with maintaining operation at the limit value. The resultant rate command 122 from the summer 79 will also be acted upon by a scaling box 123 to convert the rate command signal 122 to a signal rate command 125 to be further acted upon by the force limit region rate correction function 126. This rate correction function will consider the actual force 127 and the actual rate 128, both at a steady state mode for operating BHD 10. This resulting rate 129 can be interrupted by the switch 130 acted upon by the hoist control 132 which will consider such factors as the hoist speed limit 131, a hole depth limit 134, the stalled bit condition 117 and a clogged hole condition 136. The hoist control 132 will also operate a switch 133 in conjunction with the OR function 137 which indicates a logic operation wherein the rate command 129 or the hoist control output 190 can be fed to the scaling box 138 for the purpose of setting the rate command 28 to the proper units required by the hoist pulldown drive 26 to ultimately result in the rate of pulldown 28. It should also be noted that in conjunction with hoist control 132 that a bit position and hole depth function is provided by the depth signal 33 through depth position calculator 75. This is also presented to the bit on ground detector 121 to activate switch 188 (See FIG. 2) for the purpose of calculating a bit force only when the bit 96 is on the ground.

Figure 5:
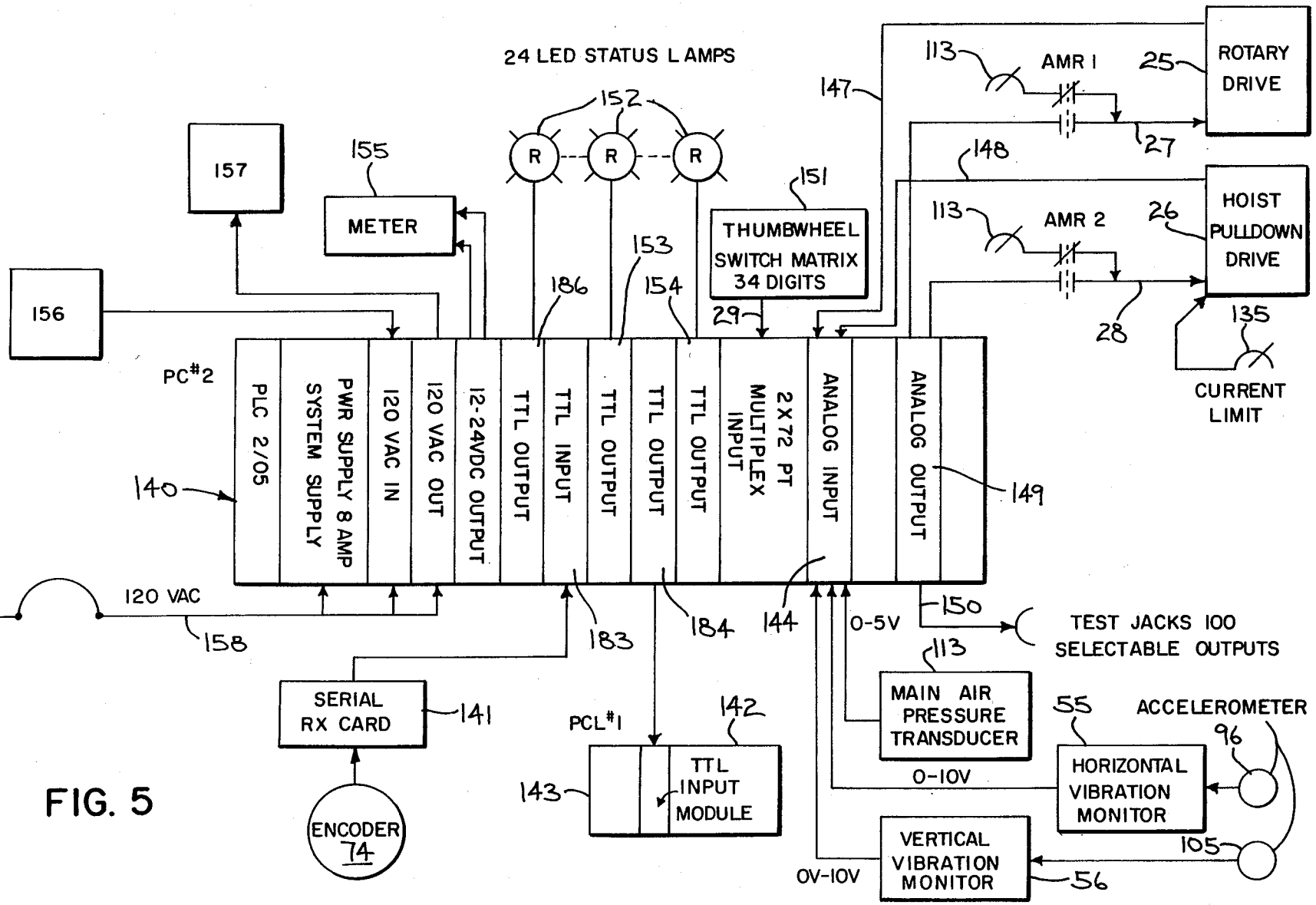
FIG. 5 is a diagrammatic illustration of the control system of this invention connected to a computer.

A computer 140 is shown in FIG. 5 to control various functions for the PADC, many of which have been previously described. It is available from the Allen-Bradley Company, Inc. and available as model No. PLC2-05. A position encoder 74 feeds head position information to the computer 140 by way of a serial receiver card 141 and a transistor-transistor logic input and output 183 and 184, respectively. Output 184 is connected to the transistor-transistor input module 142 which feeds head information to the standard programmable logic control apparatus 143. An analog input module 144 receives nine analog signal inputs. One is from an air measuring pressure transducer 113 sensing main air pressure from compressor 69; another from the horizontal vibration monitor 55 and the third from the vertical vibration monitor 56. As indicated above, the horizontal and vertical vibration monitors 55 and 56 receive signals from the accelerometers 96 and 105. Six additional analog inputs are also received in module 144, three each of which are from the rotary and hoist pulldown motion control drives. They are indicated by the input line 147 and 148, respectively and represent motor parameters of speed, armature current and terminal volts. An analog output module 149 provides three analog outputs. These are the speed control reference command signals 27 and 28 to the rotary and hoist pulldown drives 25 and 26 as well as a selectable voltage output signal 150 which can be selected to monitor one hundred locations internal to the programmable logic controller. Rotary and hoist pulldown drives 25 and 26 can be further controlled by operator controlled master rotary switches 113. The relay contacts A.M.R.1 and A.M.R.2 determine if the PADC signals 27 and 28 or the master switches 113 provide the r.p.m. and rate command to the rotary and hoist pulldown drives 25 and 26. A current limit switch 135 is also connected to the hoist pulldown drive 26.

A thumbwheel switch matrix 151 consists of 34 binary coded decimal thumb-wheel dial switches used to input drilling parameter limits 29 into the PADC software algorithms. Twenty-four light emitting diodes as shown at 152 will represent eight lines each from computer module outputs 153, 154 and 186. An LED four-digit display meter 155 is also interconnected with the computer 140 to selectively display 100 locations internal to it. A 120-volt AC input module 156 consists of switches, push buttons and logic signals which indicate the state of the blast hole drill to the computer such as an automatic drill on/off or automatic drill automatic/-manual mode. An output interface 157 consists of reed relays and indicating lamps which indicate the state of the PADC to other blast hole drill components such as a bit on bottom, stalled bit or clogged hole condition and as well as A.M.R.1, and A.M.R.2. The usual DC power block line 158 provides the necessary voltage and current requirements for the computer 140.

Figure 6A:
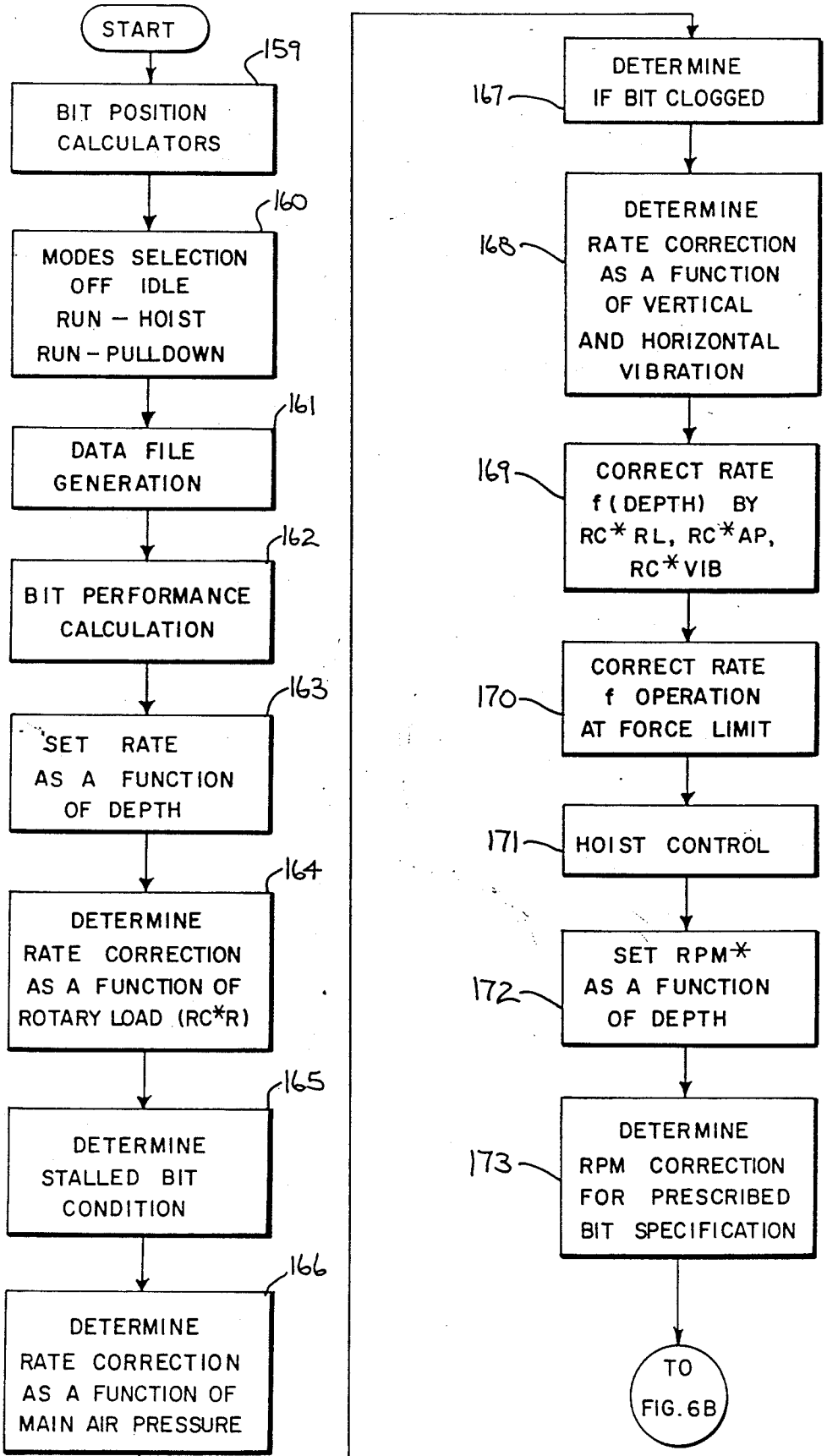
FIGS. 6A and 6B are flow charts showing a general signal flow block diagram for the drill control system of this invention.
Figure 6B:
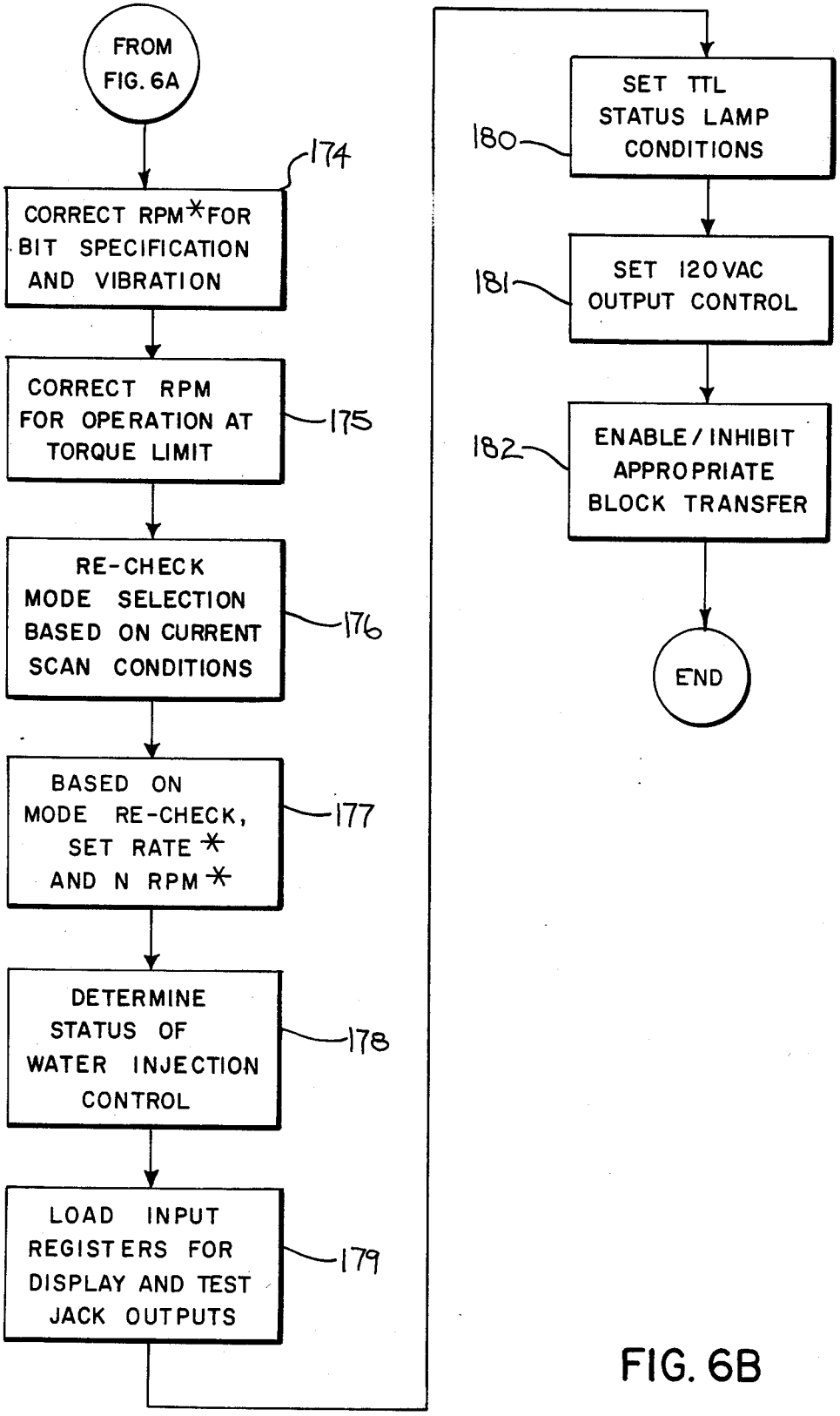

Turning to FIG. 6, a general flow block diagram is presented to indicate the various sequences of actions in operating the PADC by means of the software acted upon by the computer 140. The signal flow blocks are indicated by the reference numerals 159–182.

The first calculation is one of bit position 159 which will include collar depth 37, wet hole and end of hole depth 35. Also considered is zero bit 96 movement 76 and the bit on the bottom. A mode selection 160 is next effected based on input information and previous scan results. It includes selection of an off mode, an idle mode, a run-hoist mode and a run pulldown mode. In block 161, there is effected a data file generation wherein based on the mode selected and the block transfer status, the thumbwheel 151 data is transferred to the temporary area and then to the data storage area. Next is a bit performance calculation 162. If the mode is idle or run, there is calcuated bit rate of penetration 73 and 126, bit force 189, bit torque 71, 127 and bit r.p.m. 72, 128. The rate for HPD motor 22 is set as a function of depth such as indicated in block 163 and in function box 34 associated with sensor 32. The rate correction as a function of rotary load 187 is next effected at block 164. At block 165 a stalled bit condition is determined as at function box 93 which the PADC will attempt to correct. A rate correction is then made at 166 as a function of main air pressure such as at 101. At block 167 a clogged bit determination is made such as at 136. If bit is clogged, the auto drill will attempt to correct the problem. Rate correction as a function of vertical and horizontal vibration 56 and 55 is then made at 168. A correction of the rate as a function of depth 78 is made at 169 by rotary load 92, air pressure 112 and vibration 104 and 107. A corrected rate is made at 170 if the operation is at a force limit. Block 171 represents a determination if the PADC should activate the hoist control. A decision is made accordingly. At block 172 the r.p.m. for the motor 20 is made as a function of depth as indicated in function box 34 associated with sensor 31. An r.p.m. determination is made at 773 for operation within the prescribed bit specifications such as performed in function box 51. At block 174 there is a correction of the r.p.m. for the bit specification 54 and horizontal and vertical vibration 65 and 58. Next at 175 there is a correction of the r.p.m. for operation at torque limit as provided in function box 73. A re-check is next made at 176 of the mode selection based on current scan conditions. Based on the re-check made at 176, the r.p.m. command 27 and the rate command 28 is set at block 177. At block 178 the status of the water injection control (function box 118) based on auto-drill status is made. Next at 179 is the loading of output registers for display 155 and test jack outputs 150. The transistor-transistor logic status lamp conditions 152 are set based on auto-drill status at 180. In block 181, the 120 VAC output 157 is set based on auto drill status and in block 182 there is an enabling or inhibiting of the appropriate block transfer of the input and output data based on the mode.

The programmed automatic drill control 24 of this invention has been described in conjunction with a blast hole drill. It should be apparent to one skilled in the art that the programmed automatic drill control of this invention could be adapted to other drilling-type equipment, for example an oil drilling apparatus. Similarly, the programmed automatic drill control could be advantageously used with any type of earth drilling equipment where fast and maximum efficiency of the drilling apparatus is to be accomplished.

In the foregoing description a computer 140 has been described having various functions for indicating operation and controlling the automatic programmed drill control. Many of these, while advantageous, are not necessary such as the switches, push buttons and logic signals. Alternatively, other controls, signalling or switching devices could be used as is readily apparent to those skilled in the art.

I claim:

1. A drill control system for continuously and efficiently operating drilling machinery having a first electric motor to rotate a drill pipe with attached drilling bit and a second electric motor to operate a hoist pulldown mechanism for applying axial forces on the drill pipe, the drill control system comprising:

means to set a revolutions per minute (RPM) command value, the RPM command value representing a desired commanded rotational speed for said drill pipe;

first sensing means for sensing a first set of drilling parameter values, including drilling parameter values representing only the horizontal component of the vibration being produced by the drill pipe and the axial force being exerted on the drill pipe by the second electric motor;

RPM correction means connected to receive the RPM command value and the first set of drilling parameter values, the RPM correction means including a plurality of predetermined limit values, each predetermined limit value being associated with one drilling parameter value in the first set of drilling parameter values, the RPM correction means producing a corrected RPM command value in which the RPM correction means regulates the corrected RPM command value at the level of the RPM command value while all drilling parameter values in the first set of drilling parameter values are below the associated predetermined limits, and in which the RPM correction means regulates the corrected RPM command values at a level less than the RPM command value while any one of the drilling parameter values in the first set of drilling parameter values is equal to the associated predetermined limit so as to maintain all drilling parameter values in the first set of drilling parameter values at or below the associated predetermined limits;

first drive means connected to receive the corrected RPM command value for driving the first electric motor to achieve the rotational speed of the drill pipe corresponding to the corrected RPM command value;

means to set an axial penetration rate command value, the axial penetration rate command value representing a desired commanded axial velocity for the drill pipe in terms of axial length of drill pipe advancement per unit of time;

second sensing means for sensing a second set of drilling parameter values, including a drilling parameter values representing only the vertical component of the vibration being produced by the drill pipe and the pressure of clearing air being injected into the drill pipe;

axial penetration rate correction means connected to receive the axial penetration rate command value and the second set of drilling parameter values, the axial penetration rate correction means including a plurality of predetermined limit values, each predetermined limit value being associated with one drilling parameter value in the second set of drilling parameter values, the axial penetration rate correction means producing a corrected axial penetration rate command value in which the axial penetration rate correction means regulates the corrected axial penetration rate command value at the level of the axial penetration rate command value while all drilling parameter values in the second set of drilling parameter values are below the associated predetermined limits, and in which the axial penetration rate correction means regulates the corrected axial penetration rate command value at a level less than the axial penetration rate command value while any one of the drilling parameter values in the second set of drilling parameter values is equal to the associated predetermined limit so as to maintain all drilling parameter values in the second set of drilling parameter values at or below the associated predetermined limit;

second drive means connected to receive the corrected axial penetration rate command value for driving the second electric motor to achieve the axial velocity of the drill pipe corresponding to the corrected axial penetration rate command value.

2. The drill control system of claim 1 which includes:

means for setting a collar depth value;

means for setting a normal RPM value;

means for setting a collaring RPM value;

means for setting a normal axial penetration rate value;

means for setting a collar axial penetration rate value; and means for sensing the current depth of the hole and producing a current hole depth value;

and in which the means to set an RPM command value includes means for setting the RPM command value as a function of the current hole depth value, wherein if the current hole depth value is less than the collar depth value then the RPM command value is set to the collaring RPM value, and if the current hole depth value is greater than or equal to the collar depth value then the RPM command value is set to the normal RPM value;

and in which the means to set an axial penetration rate command value includes means for setting the axial penetration rate command value as a function of the current hole depth value, wherein if the current hole depth value is less than the collar depth value then the axial penetration rate command value is set to the collar axial penetration rate value, and if the current hole depth value is greater than or equal to the collar depth value then the axial penetration rate command value is set to the normal RPM value.

3. The drill control system of claim 1 in which the second sensing means includes means for sensing the current being drawn by the first electric motor, and the second set of drilling parameter values includes a value representing the current being drawn by the first electric motor, and in which the axial penetration rate correction means includes a cooldown control means, the cooldown control means comprising:

average current calculation means connected to the current sensing means for accumulating a time average effective current value of the current being drawn by the first electric motor;

current regulator means also connected to current sensing means, the current regulator means producing an output proportional to the amount by which the sensed current exceeds the current rating of the first electric motor; and switching means connected to receive the time average effective current value, the switching means being operative to test the time average effective current value against the current rating of the first electric motor, and if the current rating is exceeded, then the switching means applies the output of the current regulator means to the axial penetration rate correction means for reduce the corrected axial penetration rate command value for as long as the current rating is exceeded.

4. The drill control system of claim 1 which includes:

rotary current sensing means for sensing the current being drawn by the first electric motor in producing rotary motion of the drill pipe;

rotary speed sensing means for sensing the rotary speed of the drill pipe;

stalled bit detection means connected to the rotary current sensing means and the rotary speed sensing means, the stalled bit detection means producing a stalled bit induction to the hoist control means when the rotary speed of the drill pipe falls below a predetermined minimum rotary speed value and the rotary current exceeds a predetermined maximum rotary current value; and control means connected to the stalled bit detection means and to the means for setting the RPM command value and the axial penetration rate command value, wherein upon reception of a stalled bit indication from the stalled bit detection means, the control means forces the RPM command value and the axial penetration rate command value to zero, and provides a fault indication of the stalled bit condition.

5. The drill control system of claim 1 which includes:

hoist control means for controlling the operation of the second electric motor, the hoist control means including switching means interposed between the axial penetration rate correction means and the second drive means in order to selectively interrupt the connection of the corrected axial penetration rate command value to the second drive means and instead produce a hoist command value and connect the hoist command value to the second drive means, the hoist command value causing the second drive means to reverse the direction of the second electric motor thereby reversing direction of the axial velocity of the drill pipe;

and in which the axial penetration rate correction means includes means for decreasing the corrected axial penetration rate command value when the drilling parameter value representing the pressure of air being injected into the drill pipe is near the associated predetermined limit value, and in which the axial penetration rate correction means includes means for providing a clogged bit indication to the hoist control means if the pressure of air being injected into the drill pipe is greater than or equal to the associated predetermined limit value;

wherein upon reception of the clogged bit indication from the clogged bit detection means, the hoist control means engages the switching means to automatically raise the drill pipe to relieve the clogged bit condition without manual intervention.

6. A method for continuously and efficiently operating drilling machinery having a first electric motor to rotate a drill pipe with attached drilling bit and a second electric motor to operate a hoist pulldown mechanism for applying axial forces on the drill pipe, the method comprising:

setting a revolutions perminute (RPM) command value, the RPM command value representing a desired commanded rotational speed for said drill pipe;

sensing a first set of drilling parameter values, including drilling parameter values representing only the horizontal component of the vibration being produced by the drill pipe and the axial force being exerted on the drill pipe by the second electric motor;

producing a corrected RPM command value based on the RPM command value, the first set of drilling parameter values, and a plurality of predetermined limit values, each predetermined limit value being associated with one drilling parameter value in the first set of drilling parameter values, such that the corrected RPM command value is regulated at the level of the RPM command value while all drilling parameter values in the first set of drilling parameter values are below the associated predetermined limits, and such that the corrected RPM command value is regulated at a level less than the RPM command value while any one of the drilling parameter values in the first set of drilling parameter values is equal to the associated predetermined limit so as to maintain all drilling parameter values in the first set of drilling parameter values at or below the associated predetermined limit;

driving the first electric motor to achieve the rotational speed of the drill pipe corresponding to the corrected RPM command value;

setting an axial penetration rate command value, the axial penetration rate command value representing a desired commanded axial velocity for the drill pipe in terms of axial length of drill pipe advancement per unit of time;

sensing a second set of drilling parameter values, including drilling values representing only the vertical component of the vibration being produced by the drill pipe and the pressure of an clearing medium being injected into the drill pipe;

producing corrected axial penetration rate command value based on the axial penetration rate command value, the second set of drilling parameter values, and a plurality of predetermined limit values, each predetermined limit value being associated with one drilling parameter value in the second set of drilling parameter values, such that the corrected axial penetration rate command value is regulated at the level of the axial penetration rate command value while all drilling parameter values in the second set of drilling parameter values are below the associated predetermined limits, and such that corrected axial penetration rate command value is regulated at a level less than the axial penetration rate command value while any one of the drilling parameter values in the second set of drilling parameter values is equal to the associated predetermined limit so as to maintain all drilling parameter values in the second set of drilling parameter values at or below the associated predetermined limit;

driving the second electric motor to achieve the axial velocity of the drill pipe corresponding to the corrected axial penetration rate command value.

7. The method of claim 6 which includes the steps of:

setting a normal RPM value;

setting a collar depth value;

setting a collaring RPM value; and sensing the current depth of the hole and producing a current hole depth value;

and in which the step of setting a RPM command value sets the RPM command value as a function of the current hole depth value, wherein if the current hole depth value is less than the collar depth value then the RPM command value is set to the collaring RPM value, and if the current hole depth value is greater than or equal to the collar depth value then the RPM command value is set to the normal RPM value;

and in which the step of setting an axial penetration rate command value sets the axial penetration rate command value as a function of the current hole depth value, wherein if the current hole depth value is less than the collar depth value then the axial penetration rate command value is set to the collar axial penetration rate value, and if the current hole depth value is greater than or equal to the collar depth value then the axial penetration rate command value is set to the normal axial penetration rate value.

8. The method of claim 6 in which the step of sensing a second set of drilling parameter values includes sensing the current being drawn by the first electric motor, and the second set of drilling parameter values includes a value representing the current being drawn by the first electric motor, and in which the step of producing a corrected axial penetration rate command value includes the steps of:

accumulating a time average effective current value of the sensed current being drawn by the first electric motor;

producing a current regulator output proportional to the amount by which the sensed current exceeds the current rating of the first electric motor; and testing the time average effective current value against the current rating of the first electric motor, and if the current rating is exceeded, then reducing the corrected axial penetration rate command value for as long as the current rating is exceeded.

9. The method of claim 6 which includes the steps of:

sensing the current being drawn by the first electric motor in producing rotary motion of the drill pipe;

sensing the rotary speed of the drill pipe;

producing a stalled bit indication when the rotary speed of the drill pipe falls below a predetermined minimum rotary speed value and the rotary current exceeds a predetermined maximum rotary current value; and upon activation of the stalled bit indication, forcing the RPM command value and the axial penetration rate command value to zero, and providing a fault indication for the stalled bit condition.

10. The method of claim 6 which includes the steps of:

decreasing the corrected axial penetration rate command value when the drilling parameter value representing the pressure of air being injected into the drill pipe is near the associated predetermined limit value, and providing a clogged bit indication to the hoist control means if the pressure of air being injected into the drill pipe is greater than or equal to the associated predetermined limit value;

wherein upon activation of the clogged bit indication from the clogged bit detection means, raising the drill pipe to relieve the clogged bit condition without manual intervention.

* * * * *

UNITED STATES PATENT AND TRADEMARK OFFICE

CERTIFICATE OF CORRECTION

PATENT NO. : 4,793,421

DATED : December 27, 1988

INVENTOR(S) : Jasinski

It is certified that error appears in the above-identified patent and that said Letters Patent is hereby corrected as shown below:

| | |
|---|---|
| Column 2, line 14 | "that" should read --the-- |
| Column 2, line 41 | "o" should read --of-- |
| Column 2, line 61 | "b" should read --be-- |
| Column 3, line 65 | "algorithm" should read --algorithms-- |
| Column 5, line 39 | "$Ia^2 32$" should read --$Ia^2$=-- |
| Column 5, line 43 | "100" should read --180-- |
| Column 9, line 3 | "773" should read --173-- |
| Column 10, line 4 | "values" should read --value-- |
| Column 10, line 24 | after "including" delete "a" |
| Column 11, line 45 | "for" should read --to-- |
| Column 11, line 57 | "induction" should read --indication-- |

UNITED STATES PATENT AND TRADEMARK OFFICE

CERTIFICATE OF CORRECTION

PATENT NO. : 4,793,421

DATED : December 27, 1988

INVENTOR(S) : Jasinski

It is certified that error appears in the above-identified patent and that said Letters Patent is hereby corrected as shown below:

| | |
|---|---|
| Column 13, line 10 | after "drilling" --parameter-- should appear |
| Column 13, line 14 | after "producing" --a-- should appear |
| Column 13, line 25 | after "that" --the-- should appear |

Signed and Sealed this

Seventeenth Day of October, 1989

*Attest:*

DONALD J. QUIGG

*Attesting Officer*

*Commissioner of Patents and Trademarks*